US007466942B2

(12) United States Patent
Zona et al.

(10) Patent No.: US 7,466,942 B2
(45) Date of Patent: Dec. 16, 2008

(54) DIRECT CHARGING DEVICE USING NANO-STRUCTURES WITHIN A METAL COATED PORE MATRIX

(75) Inventors: Michael F. Zona, Holley, NY (US); Joseph A. Swift, Ontario, NY (US); Dan A. Hays, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 427 days.

(21) Appl. No.: 11/398,676

(22) Filed: Apr. 6, 2006

(65) Prior Publication Data

US 2007/0237546 A1 Oct. 11, 2007

(51) Int. Cl.
*G03G 15/02* (2006.01)

(52) U.S. Cl. ..... 399/168

(58) Field of Classification Search ..... 399/168, 399/171, 173, 310, 315; 361/212, 213, 225, 361/226, 229, 230; 250/324–326
See application file for complete search history.

(56) References Cited

U.S. PATENT DOCUMENTS

| | | | | | |
|---|---|---|---|---|---|
| 3,611,074 | A * | 10/1971 | Weichardt | ..... | 361/229 |
| 3,758,779 | A * | 9/1973 | Thicthener | ..... | 250/325 |
| 3,766,382 | A * | 10/1973 | Lin | ..... | 250/324 |
| 4,064,439 | A * | 12/1977 | Yang | ..... | 250/324 |
| 4,794,254 | A * | 12/1988 | Genovese et al. | ..... | 250/324 |
| 4,803,593 | A * | 2/1989 | Matsumoto et al. | ..... | 361/225 |
| 7,228,091 | B2 * | 6/2007 | Hays et al. | ..... | 399/168 |
| 7,398,035 | B2 * | 7/2008 | Zona et al. | ..... | 399/168 |

* cited by examiner

*Primary Examiner*—Susan S Lee
(74) *Attorney, Agent, or Firm*—MH2 Technology Law Group LLP

(57) ABSTRACT

In accordance with the invention, there is an electrophotographic charging device including a first electrode, a second electrode adjacent the first electrode, a plurality of nanostructures adhering to the first electrode, and voltage supplies electrically connected to the first electrode and the second electrode, wherein the voltage difference between the first electrode and the second electrode creates a high electric field at the nanostructures to cause charge species generation that is deposited on a receptor.

22 Claims, 5 Drawing Sheets

DIRECT CHARGING DEVICE USING NANO-STRUCTURES WITHIN A METAL COATED PORE MATRIX

FIELD OF THE INVENTION

The subject matter of this invention relates to charging devices. More particularly, the subject matter of this invention relates to charging devices having nanostructures within pores of a porous material for use in an electrophotographic apparatus.

BACKGROUND

In the electrophotographic process, various charging devices are used to charge a photoreceptor ("receptor"), recharge a toner layer, charge an intermediate transfer belt for electrostatic transfer of toner, or charge a sheet of media, such as a sheet of paper. Conventional non-contact charging devices typically apply high DC voltages to wires or pins, such as corotrons, scorotrons, and dicorotrons, to produce ions for charging. Problems arise because the undesired highly reactive oxidizing species that are also generated in the process degrade the photoreceptor and may cause air pollution. Alternative contact charging devices use high AC voltages to charge small diameter drums. Problems arise with contact charging devices because the reactants generated also degrade the photoreceptor. Moreover, conventional charging devices require high voltages and relatively large sizes (e.g., the length in the process direction) for high process speed electrophotographic machines.

Thus, there is a need to overcome these and other problems of the prior art to provide a method and system for direct charging of the receptor, and to reduce the undesired reactive oxidizing species generated through the charging process.

SUMMARY

In accordance with the invention, there is an electrophotographic charging device including a first conductive layer and a porous layer disposed on the first conductive layer, wherein the porous layer comprises a plurality of pores. The charging device can also include a second conductive layer disposed on the first layer and at least one nanostructure disposed within each of the plurality of pores of the first layer, wherein the at least one nanostructure is electrically connected to the first conductive layer. The charging device can further include a receptor disposed opposing the second conductive layer and a first power supply electrically connected to the first conductive layer to apply a first bias voltage to the first conductive layer.

In accordance with the invention, there is a method of charging a receptor in an electrophotographic charging device. The method can include providing a porous layer comprising a plurality of pores, wherein the porous layer is disposed on a conductive substrate. At least one nanostructure disposed within each of the pores of the first layer can be provided, wherein the nanostructures are electrically connected to the conductive substrate. A second conductive layer disposed on the first layer can also be provided. A first voltage can be applited to the conductive substrate and a second voltage to the second conductive layer to enable generation of a plurality of charged species. The receptor can then be charged by depositing the plurality of charged species on the receptor.

It is to be understood that both the foregoing general description and the following detailed description are exemplary and explanatory only and are not restrictive of the invention, as claimed.

The accompanying drawings, which are incorporated in and constitute a part of this specification, illustrate one several embodiments of the invention and together with the description, serve to explain the principles of the invention.

DESCRIPTION OF THE EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

Figure 1:
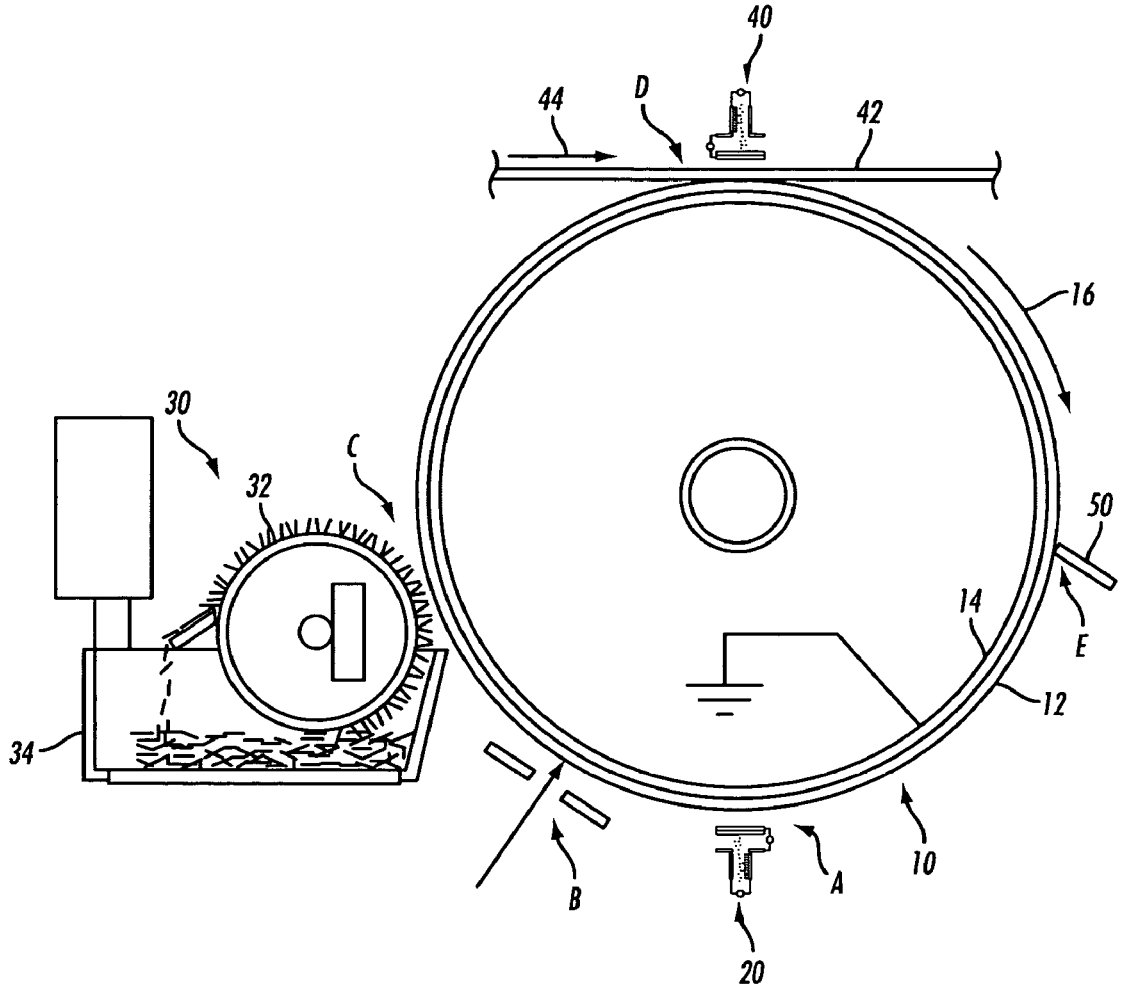
FIG. 1 is a schematic view showing an electrophotraphic printing apparatus according to various embodiments of the invention.

Referring initially to FIG. 1, prior to describing the specific features of the exemplary embodiments, a schematic depiction of the various components of an exemplary electrophotographic reproduction apparatus incorporating charging devices, various embodiments of which are described in more detail below, is provided. Although the exemplary apparatus is particularly well adapted for use in an electrophotographic reproduction machine, it will be apparent from the following discussion that the present charging devices are equally well suited for use in a wide variety of electrostatographic processing machines as well as other systems that include the use of a charging device. In particular, it should be noted that the charging devices of the exemplary embodiments can also be used in the toner transfer, detack, discharge, erase, preclean, or cleaning subsystems of a typical electrostatographic copying or printing apparatus because such subsystems can include the use of a charging device.

The exemplary electrophotographic reproducing apparatus of FIG. 1 can include a drum with a photoconductive surface 12 deposited on an electrically grounded conductive substrate 14. A motor (not shown) can engage with drum 10 for rotating the drum 10 in the direction of arrow 16 to advance successive portions of photoconductive surface 12 through various processing stations disposed about the path of movement thereof, as will be described. Initially, a portion of drum 10 passes through charging station A. At charging station A, a charging device, indicated generally by reference numeral 20, charges the photoconductive surface 12 on drum 10.

Once charged, the photoconductive surface 12 can be advanced to imaging station B where an original document (not shown) can be exposed to a light source (also not shown) for forming a light image of the original document onto the charged portion of photoconductive surface 12 to selectively dissipate the charge thereon, thereby recording onto drum 10 an electrostatic latent image corresponding to the original document.

One of ordinary skill in the art will appreciate that various methods can be used to irradiate the charged portion of the photoconductive surface 12 for recording the latent image thereon. For example, a properly modulated scanning beam of electromagnetic radiation (e.g., a laser beam) can be used to irradiate the portion of the photoconductive surface 12.

After the electrostatic latent image is recorded on photoconductive surface 12, the drum is advanced to development station C where a development system, such as a so-called magnetic brush developer, indicated generally by the reference numeral 30, deposits developing material onto the electrostatic latent image.

The exemplary development system 30 shown in FIG. 1 includes a single development roller 32 disposed in a housing 34, in which toner particles are typically triboelectrically charged by mixing with larger, conductive carrier beads in a sump to form a developer that is loaded onto developer roller 32 that can have internal magnets to provide developer loading, transport, and development. The developer roll 32 having a layer of developer with the triboelectric charged toner particles attached thereto can rotate to the development zone whereupon the magnetic brush develops a toner image on the photoconductive surface 12. It will be understood by those of ordinary skill in the art that numerous types of development systems can be used.

Referring again to FIG. 1, after the toner particles have been deposited onto the electrostatic latent image for development, drum 10 can advance the developed image to transfer station D, where a sheet of support material 42 is moved into contact with the developed toner image in a timed sequence so that the developed image on the photoconductive surface 12 contacts the advancing sheet of support material 42 at transfer station D. A charging device 40 can be provided for creating an electrostatic charge on the backside of support material 42 to aid in inducing the transfer of toner from the developed image on photoconductive surface 12 to the support material 42.

After image transfer to support material 42, support material 42 can be subsequently transported in the direction of arrow 44 for placement onto a conveyor (not shown) which advances the support material 42 to a fusing station (not shown) that permanently affixes the transferred image to the support material 42 thereby for a copy or print for subsequent removal of the finished copy by an operator.

According to various embodiments, after the support material 42 is separated from the photoconductive surface 12 of drum 10, some residual developing material can remain adhered to the photoconductive surface 12. Thus, a final processing station, such as cleaning station E, can be provided for removing residual toner particles from photoconductive surface 12 subsequent to separation of the support material 42 from drum 10.

Cleaning station E can include various mechanisms, such as a simple blade 50, as shown, or a rotatably mounted fibrous brush (not shown) for physical engagement with photoconductive surface 12 to remove toner particles therefrom. Cleaning station E can also include a discharge lamp (not shown) for flooding the photoconductive surface 12 with light or preclean erase (not shown) of the type similar to the present charging device 20 and 40 in order to erase or dissipate any residual electrostatic charge remaining thereon in preparation for a subsequent image cycle.

According to various embodiments, an electrostatographic reproducing apparatus may take the form of several well known devices or systems. Variations of the specific electrostatographic processing subsystems or processes described herein can be applied without affecting the operation of the present teachings.

FIGS. 2-7 depict various charging devices that can be used to charge or discharge, for example, a receptor in the electrophotographic process. The exemplary charging devices can use less voltage than conventional charging devices and produce a reduced amount of oxidizing agents, such as, ozone and $NO_x$. Exemplary receptors can include a photoreceptor, such as the photoconductive surface 12, a toner layer, a sheet of media on which toner can be deposited, or a transfer belt. According to various embodiments, the exemplary charging devices described herein can include a porous layer disposed on a first conductive layer, where each of the pores of the porous layer includes one or more nanostructures.

Figure 2:
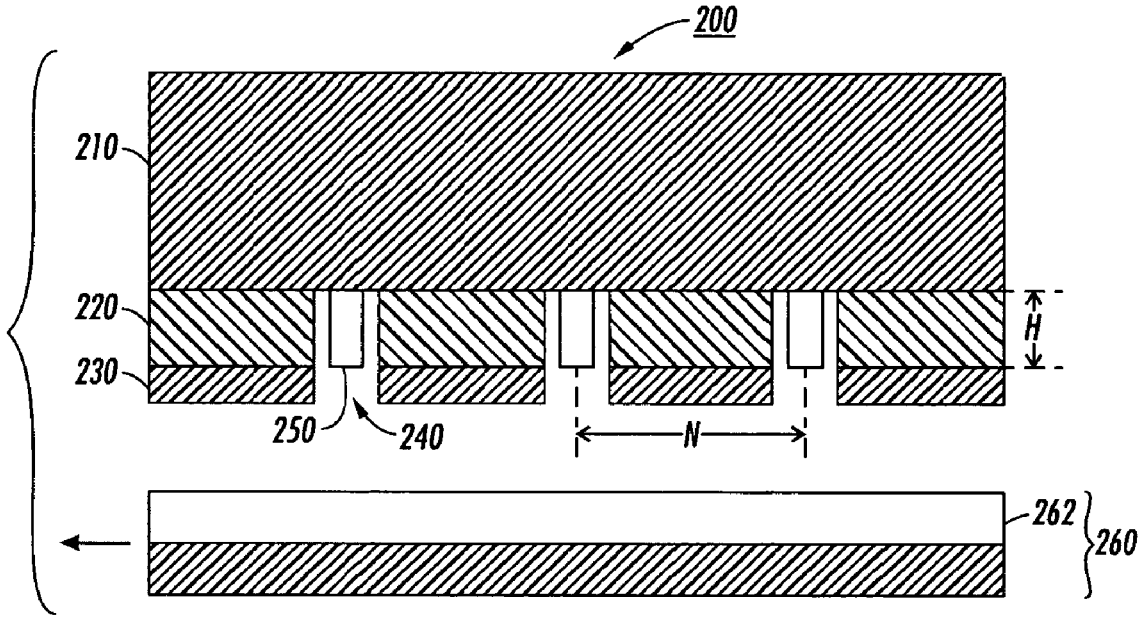
FIG. 2 depicts an exemplary charging device according to various embodiments of the invention.

FIG. 2 shows a cross sectional view of a charging device 200 in accordance with the present teachings. Charging device 200 can include a first conductive layer 210, a porous layer 220 with a plurality of pores 240 disposed on first conductive layer 210, and a second conductive layer 230 disposed on porous layer 220. Charging device 200 can further include at least one nanostructure 250 in each pore of porous material 220, where the nanostructures are in electrical contact with first conductive layer 210. A receptor 260 including a photoconductive surface 262 can be disposed opposing and apart from the second conductive layer 230.

First conductive layer 210 can be, for example, a substrate formed of any conductive material including, but not limited to, metals, insulators including a conductive surface (e.g., indium tin oxide coated glass), metal filled polymers, doped ceramics, and conductive organic composite materials.

Porous layer 220 can be formed of an insulating or substantially insulating material. Exemplary materials include, but are not limited to, polymers, ceramics, glasses, inorganic salts, polymer composites, and insulating metal oxides. In an exemplary embodiment, porous layer 220 can be formed of one or more insulating, phase separable, pore forming polymers. For example, porous layer 220 can be formed from two polymers that are soluble in a solvent or blend of solvents or from two polymers that can form an emulsion or dispersion in a suitable carrier liquid. Upon drying, the two polymers can be immiscible or largely immiscible so that phase separation during drying can create the pore structure. The polymers can also remain soluble after drying and, in various embodiments, one of the polymers may crosslink. Other separation mechanisms may be used to create the desired polymer phases, such as, for example, electrophoretic separation, sedimentation, and the like. Upon separation of the polymer phases, the pore structure can then be formed by removing the polymer that fills the pores, for example, by using a solvent that is a non-solvent for the other polymer. According to various embodiments, the remaining polymer that forms porous layer 220 does not interfere with formation of second conductive layer 230 formed over porous layer 220. Further one or both of the polymers can be relatively inexpensive, readily available, and non-toxic. In an exemplary embodiment, a diblock copolymer of polysterene (PS) and poly(4-vinylpyridine) (PVP) where PVP is associated with molecules of 2-(4'-hydroxybenzeneazo) benzoic acid (HABA) by hydrogen bonds can be used. The block copolymer can self-organize into a hexagonal array of nanoscopic pores or cylinders from PVP and HABA embedded into PS matrix. Vapor annealing of block copolymer films can promote the orientation of the cylinders to be normal to the substrate. The cylinders can be transformed into pores by the extraction of HABA with a selective solvent.

In various other embodiments, nanoporous templates can be used as porous layer 220. Examples of nanoporous templates includes polycarbonate track etched (PCTE) membranes (e.g., from Sterlitech Co., Kent, Wash.) and alumina templates, for example, formed by anodic oxidation.

Figure 3A:
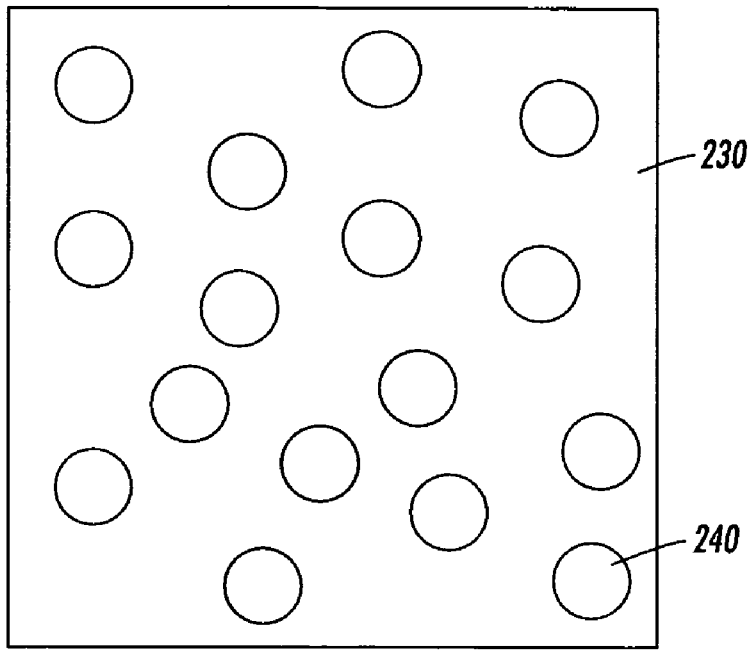
FIG. 3A depicts an exemplary pore arrangement for a charging device according to various embodiments of the invention.
Figure 3B:
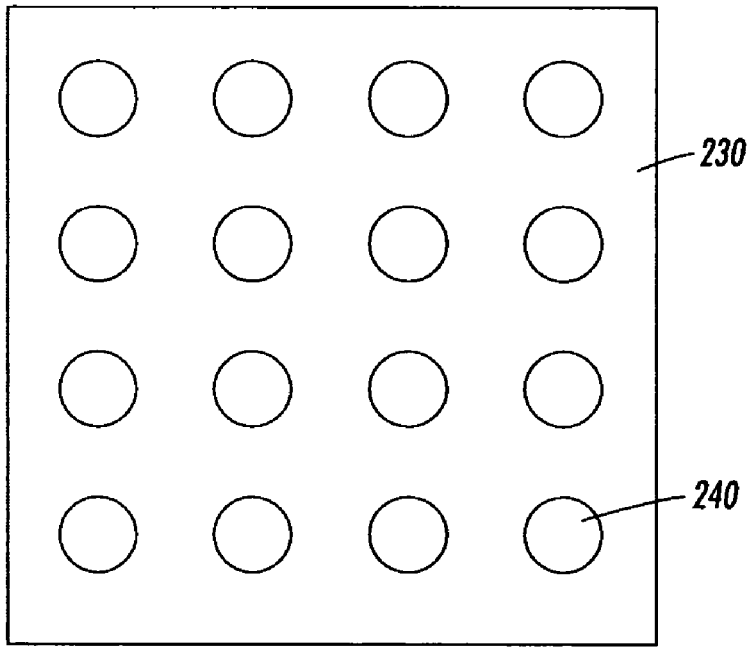
FIG. 3B depicts another exemplary pore arrangement for a charging device according to various embodiments of the invention.

Pores 240 of porous layer 220 can have a diameter from about 5 nm to about 1000 nm. Although the pores are depicted as circular in the figures, the cross sectional shape of pores 240 can be any suitable shape including, but not limited to, circular, oval, trilobal circular, and higher lobal circular. Referring to the top views of FIGS. 3A-C, pores 240 can be spaced apart in a regular or an irregular manner, for example as shown in FIG. 3A where the inter-pore spacing between pores is not constant. Alternately, the pores can be arranged in a regular pattern for example, in a columnar vertical array as shown in FIG. 3B.

Figure 4:
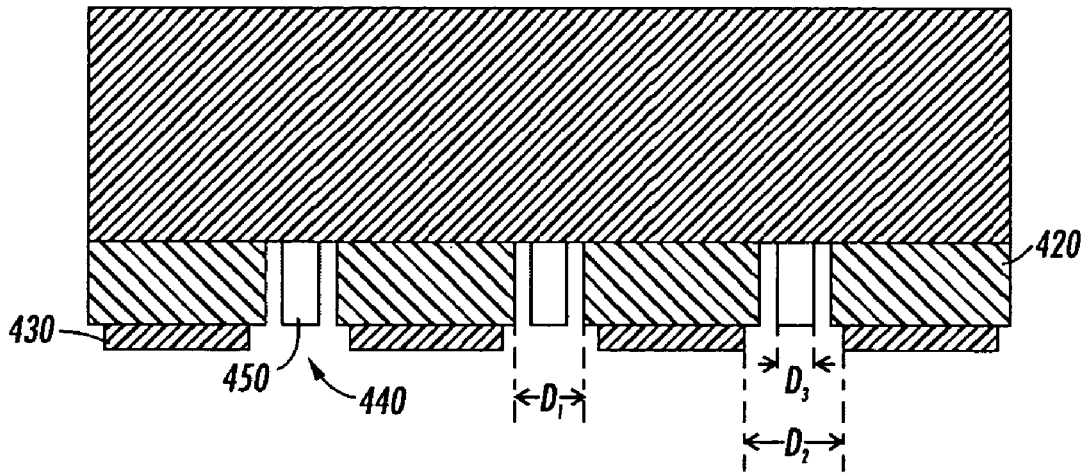
FIG. 4 depicts an exemplary charging device according to various embodiments of the invention.

Second conductive layer 230 can be formed of any conductive material, such as, for example, a metal, an alloy, or a conductive composite. In various embodiments, a diameter of pores 240 can be the same as a diameter of the openings of second conductive layer 230, as shown in FIG. 2. In various other embodiments, as shown in FIG. 4, a porous layer 420 can have pores 440 with a diameter $D_1$ and a second conductive layer 430 with openings With a diameter $D_2$, and the nanoelements 450 have a diameter $D_3$ where $D_3$ is less than $D_1$ and $D_1$ is less than $D_2$. As discussed below, the gap between $D_3$ and $D_2$, coupled with the applied voltages can establish the field that creates the corona.

Referring back to FIG. 2, the nanostructures 250 can be of one or more of single-walled nanotubes (SWNT), multi-walled nanotubes (MWNT), rods, wires, cones, and fibers. Nanostructures can be formed of one or more elements from Groups IV, V, VI, VII, VIII, IB, IIB, IVA, and VA, including metals and alloys and mixtures of these elements. Nanostructures can be fabricated by a number of methods including, but not limited to, vapor deposition, vacuum metallization, electro-plating, and electroless plating. However, it will be understood by those of ordinary skill in the art that other fabrication methods can also be used. According to various embodiments, the nanostructures 250 can be formed to have their principle axis essentially perpendicular to the substrate on which they are adhered, such as the first conductive layer 210. In various other embodiments, the nanostructures 250 can be oriented from about 0 degrees to about 80 degrees relative to a normal to first conductive layer 210. Further, nanostructures 250 can be disposed within pores 240 in an irregular manner. Alternatively, the nanostructures can be disposed within pores 240 in a columnar vertical array.

In an exemplary embodiment, nanostructures 250 can be high aspect ratio nanowires. According to various embodiments, a thick metal film can be sputtered onto one side of, for example, a PCTE membrane (e.g., Sterlitech Co., Kent, Wash.). The metal film can then be attached to first conductive layer 210 and electrochemical deposition can be used to form the nanowires within the channels of the PCTE membrane.

Figure 5:
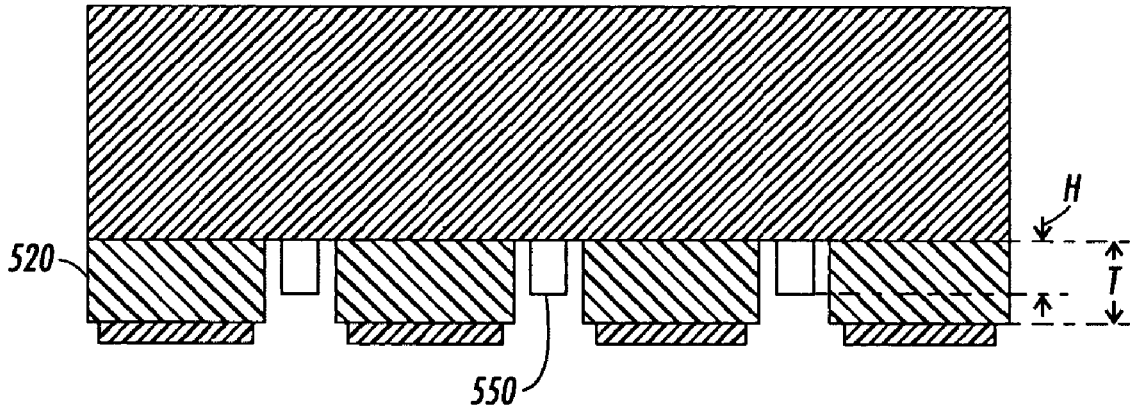
FIG. 5 depicts another exemplary charging device according to various embodiments of the invention.

The aspect ratio of nanostructures 250 can be defined as the ratio of the nanostructure's length to the nanostructure's diameter. In various embodiments, the aspect ratio of the nanostructures can be 2 or more. Further a ratio of a spacing distance between the nanostructures (N) and a height of the nanostructures (H) can be about 1000 or less. The thickness of porous layer 220 can be equal the height H of nanostructure 250, as shown in FIG. 2. According to various other embodiments, as shown in FIG. 5, a thickness T of porous layer 520 can be greater than the height H of nanostructure 550.

Figure 6:
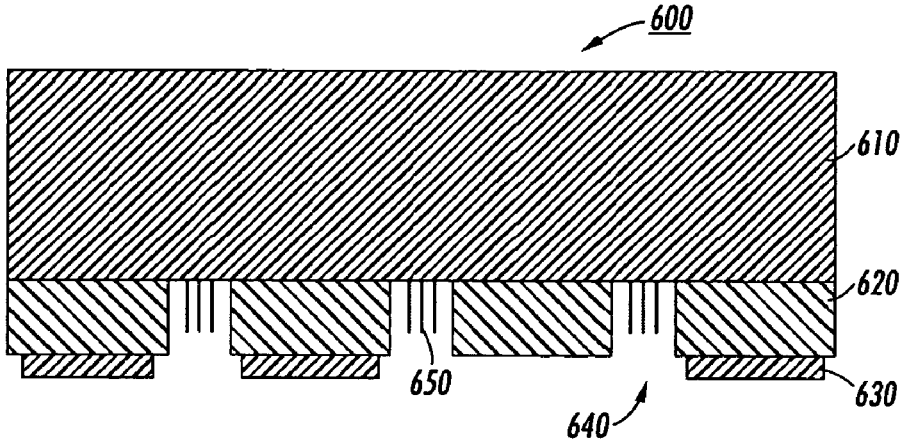
FIG. 6 depicts an exemplary charging device including a plurality of nanostructures within each pore according to various embodiments of the invention.

According to various embodiments, each pore of the porous material can include more than one nanostructure. As shown in FIG. 6, a charging device 600 can include a first conductive layer 610, a porous layer 620 disposed on first conductive layer 610, and a second conductive layer 630 disposed over porous layer 620. Porous layer 620 can include a plurality of pores 640, where each pore has more than one nanostructure 650 electrically connected to first conducting layer 610.

Receptor 260 can be a photoreceptor including a photoconductive surface 262 of a photoreceptor drum or belt. In various other embodiments receptor 260 can be a toner layer, a sheet of media on which toner can be deposited, or a transfer belt.

Figure 7:
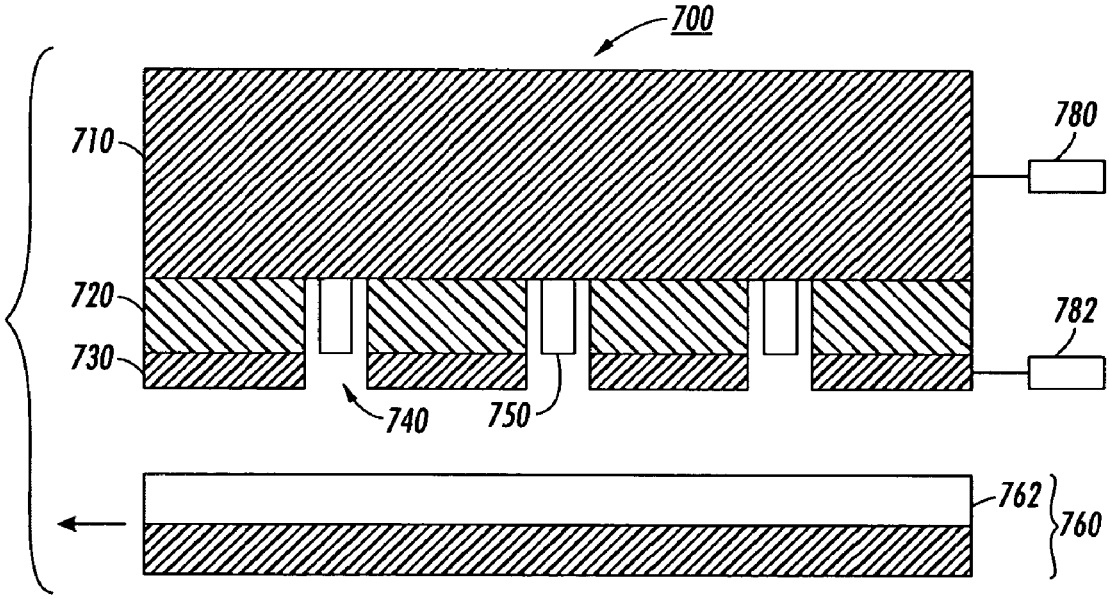
FIG. 7 depicts an exemplary method for charging a receptor according to various embodiments of the invention.

The operation of the exemplary charging devices that can charge or discharge a receptor will now be discussed. Referring to FIG. 7, a charging device 700 can include a first conductive layer 710, a porous layer 720 with a plurality of pores 740 disposed on first conductive layer 710, and a second conductive layer 730 disposed on porous layer 720. Charging device 700 can further include at least one nanostructure 750 in each pore of porous material 720, where the nanostructures are in electrical contact with first conductive layer 710. A receptor 760 including a photoconductive surface 762 can be disposed opposing and apart from the second conductive layer 730. In various embodiments, receptor 760 can move relative to second conductive layer 730, as depicted by the arrow in FIG. 7. A first voltage can be supplied to first conductive layer 710 by a first power supply 780 and a second voltage can be applied to second conductive layer 730 by a second power supply 782. In various embodiments, a voltage differential between the first voltage and the second voltage can be about 2000 V or less. Moreover, prior to applying the first and the second voltages, photoconductor surface 762 can have a surface potential representing ground potential. The first voltage can be a DC voltage or a pulsed DC voltage. The second voltage can be a DC voltage.

The field created by the voltage difference between the first voltage supplied by first power supply 780 and the voltage supplied by the second power supply can generate a corona at an end of each of the plurality of nanostructures to charge or discharge photoconductor surface 762. While not intending to be limited to any particular theory, it is believed that by applying the first voltage to the first conductive layer the field strength at an end of the nanostructure and applying the second voltage to the second conductors 730 creates a field that can exceed the corona threshold field of, for example, air and a corona discharge can take place. This ionization of the air molecule can create a positive ion, a free electron and/or a negative ion. Because of the high potential gradient, the positive ion will be strongly attracted toward the nanostructure (or repelled away from, the nanostructure depending on the polarity of the corona) and the negative ion and/or electron will be attracted towards photoconductor surface 762. These electrons can collide with other atoms, potentially ionizing those atoms, to generate additional electrons or ions that can move to photoconductor surface 762.

In addition, the second voltage applied to second conductive layer 782 can have a magnitude similar to the desired receptor surface potential to prevent over charging the photoconductor surface 762. Once photoconductor surface 762 reaches the magnitude of the applied DC voltage the charge species generated at the nanostructures are collected by the second conductive layer 730 rather than depositing onto photoconductor surface 762. In this manner, charging of photoconductor surface 762 can be controlled.

It should be appreciated that, while disclosed systems and methods have been described in conjunction with exemplary electrophotographic and/or xerographic image forming devices, systems and methods according to this disclosure are not limited to such applications. Exemplary embodiments of systems and methods according to this disclosure can be advantageously applied to virtually any device to which charge is to be imparted.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electrophotographic charging device comprising:

a first conductive layer;

a porous layer disposed on the first conductive layer, wherein the porous layer comprises a plurality of pores;

a second conductive layer disposed on the first layer;

at least one nanostructure disposed within each of the plurality of pores of the first layer, wherein the at least one nanostructure is electrically connected to the first conductive layer;

a receptor disposed opposing the second conductive layer; and a first power supply electrically connected to the first conductive layer to apply a first bias voltage to the first conductive layer.

2. The electrophotographic charging device according to claim 1, further comprising a second power supply electrically connected to the second conductive layer to apply a second bias voltage to the second conductive layer.

3. The electrophotographic charging device according to claim 1, wherein the porous layer disposed on the first conductive layer comprises a polymer.

4. The electrophotographic charging device according to claim 1, wherein the porous layer disposed on the first conductive layer comprises one or more of a ceramic, a glass, an inorganic salt, and a metal oxide.

5. The electrophotographic charging device according to claim 1, wherein the nanostructures comprise one or more elements from Groups IV, V, VI, VII, VIII, IB, IIB, IVA, and VA.

6. The electrophotographic charging device according to claim 1, wherein the nanostuctures have an aspect ratio of about 2 or more.

7. The electrophotographic charging device according to claim 4, wherein the nanostructures comprise one or more of single-walled nanotubes (SWNT), multi-walled nanotubes (MWNT), rods, wires, cones, and fibers.

8. The electrophotographic charging device according to claim 1, wherein a threshold for charge emission is about 2000 V or less.

9. The electrophotographic charging device according to claim 1, wherein a threshold electric field is about 6 V/μm or less.

10. The electrophotographic charging device according to claim 1, wherein a ratio of a spacing distance between the nanostructures (N) and a height of the nanostructures (H) is about 1000 or less.

11. The electrophotographic charging device according to claim 1, wherein a diameter of the pores is from about 50 nm to about 1000 nm.

12. The electrophotographic charging device according to claim 1, wherein a thickness of the porous layer is equal to or greater than a height of the at least one nanostructure.

13. The electrophotographic charging device according to claim 1, wherein the nanostructures are disposed in one of a periodic array or an irregular array.

14. The electrophotographic charging device according to claim 13, wherein the nanostructures within the pores are disposed at an angle from about 1 degree to about 80 degrees with respect to the first conductive layer.

15. A printing device comprising:

the electrophotographic charging device according to claim 1.

16. A method of charging a receptor in an electrophotographic charging device, the method comprising:

providing a porous layer comprising a plurality of pores, wherein the porous layer is disposed on a first conductive layer;

providing at least one nanostructure disposed within each of the pores of the first layer, wherein the nanostructures are electrically connected to the conductive substrate;

providing a second conductive layer disposed on the first layer;

applying a first voltage to the first conductive layer and a second voltage to the second conductive layer to enable generation of a plurality of charged species; and charging the receptor by depositing the plurality of charged species on the receptor.

17. The method of claim 16, wherein the step of applying the first voltage to the first conductive layer and the second voltage to the second conductive layer to enable generation of a plurality of charged species comprises:

applying a first voltage and a second voltage, wherein a voltage differential between the first voltage and the second voltage is about 2000 V or less; and generating charge at an end of each of the plurality of nanostructures.

18. The method of claim 16, wherein the first voltage is one of a DC bias and a pulsed DC bias voltage, and the second voltage is of a DC bias.

19. The method of claim 16, wherein a surface potential of the receptor is at ground potential prior to applying the first voltage and the second voltage.

20. The method of claim 16, wherein the step of providing the porous layer comprising the plurality of pores comprises:

forming a polymer film comprising a first polymer and a second polymer, wherein the first polymer and the second polymer phase separate during drying; and forming the pores of the porous layer by removing the second polymer using a solvent.

21. The method of claim 16, wherein the step of providing a plurality of nanostructures disposed within the pores of a porous layer comprises one or more of vapor deposition, vacuum metallization, electro-plating, and electroless plating.

22. The method of claim 16, further comprising providing a second conductive layer disposed on the porous layer to control the charging voltage on photoreceptor and limit the number of charged species deposited on the receptor.

* * * * *